US007980250B2

(12) United States Patent
Clarke

(10) Patent No.: US 7,980,250 B2
(45) Date of Patent: Jul. 19, 2011

(54) SMOKERS FILTER

(75) Inventor: Paul Francis Clarke, Northumberland (GB)

(73) Assignee: Filtrona International Limited, London (GB)

( * ) Notice: Subject to any disclaimer, the term of this patent is extended or adjusted under 35 U.S.C. 154(b) by 1555 days.

(21) Appl. No.: 10/532,638

(22) PCT Filed: Oct. 13, 2003

(86) PCT No.: PCT/GB03/04409
§ 371 (c)(1),
(2), (4) Date: Apr. 22, 2005

(87) PCT Pub. No.: WO2004/037025
PCT Pub. Date: May 6, 2004

(65) Prior Publication Data

US 2006/0011206 A1 Jan. 19, 2006

(30) Foreign Application Priority Data

Oct. 23, 2002 (GB) ..... 0224665.0

(51) Int. Cl.

| | |
|---|---|
| ***A24D 1/04*** | (2006.01) |
| ***A24D 3/06*** | (2006.01) |
| ***A24D 3/04*** | (2006.01) |
| ***A24D 1/02*** | (2006.01) |
| ***A24F 13/06*** | (2006.01) |
| ***A24F 1/20*** | (2006.01) |
| ***A24F 7/04*** | (2006.01) |
| ***A24F 7/00*** | (2006.01) |
| ***A24B 15/00*** | (2006.01) |
| ***A24B 1/04*** | (2006.01) |
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl. ..... 131/202; 131/331; 131/338; 131/339; 131/340; 131/341; 131/361; 131/365

(58) Field of Classification Search ..... 131/202, 131/338–341, 361, 365
See application file for complete search history.

(56) References Cited

U.S. PATENT DOCUMENTS 2,994,251 A 8/1961 Pollmann
3,690,326 A * 9/1972 Davenport ..... 131/340
(Continued)

FOREIGN PATENT DOCUMENTS

EP 0 105 682 A1 4/1984
(Continued)

OTHER PUBLICATIONS

Search Report dated Feb. 6, 2003 in Great Britain Application No. 0224665.0 (1 page).

*Primary Examiner* — Khanh Nguyen
*Assistant Examiner* — Matthew Hoover
(74) *Attorney, Agent, or Firm* — Flynn, Thiel, Boutell & Tanis, P.C.

(57) ABSTRACT

A tobacco smoke filter which has a tar retention of at most 50% and comprises a relatively high draw resistance downstream filtering plug of at most 50% tar retention, a relatively low draw resistance upstream filter plug of at most 22% tar retention spaced longitudinally upstream therefrom, and a filter wrapper engaging around and joining the spaced plugs to define a cavity therebetween.

20 Claims, 2 Drawing Sheets

U.S. PATENT DOCUMENTS 4,171,705 A * 10/1979 Holst et al. ..... 131/341
4,492,240 A * 1/1985 Hayes et al. ..... 131/336
4,564,030 A 1/1986 Jessup et al.
4,807,647 A * 2/1989 Hayes ..... 131/336
5,423,336 A * 6/1995 Mentzel et al. ..... 131/344
5,839,449 A * 11/1998 Banerjee et al. ..... 131/342
6,206,007 B1 * 3/2001 Yoshida et al. ..... 131/344

FOREIGN PATENT DOCUMENTS

EP 0 255 114 A1 2/1988
EP 0 885 570 A1 12/1998
GB 2 294 861 A 5/1996

* cited by examiner

SMOKERS FILTER

FIELD OF THE INVENTION

The present invention relates to tobacco smoke filters, especially for cigarettes.

BACKGROUND OF THE INVENTION

Some conventional filter cigarettes have a CO/Tar delivery ratio (each measured in mg per cigarette) of a little less than unity, though this ratio is more usually unity or greater. Tar is herein defined as Particulate Matter, Water- and Nicotine-free (PMWNF). It is very desirable to reduce CO delivery, but prior measures aimed at achieving this have resulted in unsatisfying taste delivery and/or in unsatisfactory draw performance, and/or have involved expensive filter structures.

SUMMARY OF THE INVENTION

Applicants have now surprisingly found that reduced CO delivery and reduced CO/tar delivery ratio with maintained smoker satisfaction can be provided by using a simple and cheaply constructed low tar retention filter having a relatively high draw resistance low tar retention downstream filtering plug, a relatively low draw resistance low tar retention upstream filtering plug spaced longitudinally upstream therefrom, and a filter wrapper engaged around and joining the spaced filtering plugs and defining a ventilated cavity therebetween.

The present invention provides a tobacco smoke filter which has a tar retention of at most 50% and comprises a relatively high draw resistance downstream filtering plug of at most 50% tar retention, a relatively low draw resistance upstream filter plug of at most 20% tar retention spaced longitudinally upstream therefrom, and a filter wrapper engaging around and joining the spaced plugs to define a cavity therebetween. The terms "relatively high" and "relatively low" are used to mean that the downstream plug draw resistance is higher than that of the upstream plug. The tar retention of the upstream plug is preferably less than that of the downstream plug. The downstream filtering plug preferably extends to the buccal end face of the filter. The upstream filtering plug preferably extends to the upstream end face of the filter. The cavity may contain particulate additive, e.g. particulate sorbent, preferably activated carbon.

In a filter cigarette according to the invention such a filter is joined to a wrapped tobacco rod with the upstream filter end towards the tobacco, and the cavity is ventilated—i.e. a pathway is provided for external ventilating air to pass laterally into the cavity. The filter may for example be joined to the wrapped tobacco rod by ring tipping (which engages around just the adjacent ends of filter and rod to leave much of the filter wrapper exposed) or by a full tipping overwrap (which engages around the full filter length and the adjacent end of the rod).

The filter wrapper of the filter per se, before incorporation in a filter cigarette, may be a ventilating wrapper (which provides a pathway for the passage of external ventilating air laterally therethrough into the cavity) or it may be non-ventilating. The filter wrapper may have one or more air-permeable regions in register with the cavity, or it may be wholly of air-impermeable or inherently air-permeable material; in each of these cases the filter wrapper may have one or more ventilating holes or apertures (e.g. perforations) around the cavity, but this is optional and in many instances an apertured filter wrapper is not necessary for the unattached filter per se.

Where the unattached filter has a filter wrapper of air-impermeable material and is to be used in conjunction with a full tipping overwrap of inherently air-permeable material, then it could be most convenient for the filter wrapper of the unattached filter to have one or more apertures in register with the cavity; this is not the most preferred arrangement, however, and more usually the filter wrappers of the unattached filters will not have ventilating apertures. Thus when the filter wrapper is of inherently air-permeable material, ventilating apertures (though not precluded) are usually unnecessary; and where an apertured filter wrapper is required, it will frequently be preferred to form the or each ventilating hole in the filter wrapper only during or after attachment of the preformed filter to a wrapped tobacco rod in production of the filter cigarette according to the invention.

In filter cigarettes according to the invention the wall around the cavity (e.g. the filter wrapper when ring tipping is used, or the combination of filter wrapper and tipping overwrap) must be ventilating—i.e. provide a pathway for the passage of external ventilating air laterally therethrough into the cavity. A tipping overwrap in a filter cigarette according to the invention must thus be a ventilating overwrap around a ventilating filter wrapper; the tipping overwrap may for example have one or more air-permeable regions or be wholly of inherently air-permeable material, and/or it may have one or more ventilating holes or apertures (e.g. perforations); and a ventilating pathway thus provided through the tipping overwrap should of course be in register with a ventilating pathway through the filter wrapper and with the cavity.

In one preferred embodiment of filter cigarette according to the invention the filter wrapper is of inherently air-permeable material, and an apertured (e.g. perforated) tipping overwrap, with one or more holes around the cavity, is employed to incorporate the filter in a filter cigarette. Another preferred embodiment uses a tipping overwrap with no ventilating holes to join a wrapped tobacco rod to a filter according to the invention having a filter wrapper with no ventilating holes, and coinciding holes or apertures (e.g. perforations) around the cavity are formed simultaneously through both overwrap and underlying filter wrapper to provide for ventilation into the cavity.

Ventilating perforations when present in a filter wrapper and/or tipping overwrap will usually be distributed in one or more rows extending longitudinally of or around the cavity, but other arrangements are possible, and ventilation can be augmented (or provided instead) by larger holes or apertures of any arrangement or distribution.

The filter may be of conventional length—e.g. from 25 to 30 mm. The cavity may for example be from 5 to 10 mm long. The downstream filtering plug may be of about the same length as the upstream filtering plug (e.g. about 10 mm), but the upstream plug could be the shorter of the two.

The pressure drop (PD)—also termed draw resistance (DR)—of the downstream filtering plug can for example be from 40 to 130 mm water gauge (WG), preferably from 60 to 110 mm WG, e.g. about 90 mm WG. The tar retention of the downstream filter plug is preferably from 30 to 50%, more preferably from 35 to 45%, e.g. about 40%. The pressure drop of the upstream filtering plug can for example be up to 20 mm WG, preferably from 8 to 16 mm WG, e.g. about 12 mm WG. The tar retention of the upstream filtering plug is up to 22%, preferably from 14 to 20%, e.g. about 18%.

The downstream filtering plug is preferably of bonded filamentary tow and its required performance can be obtained by using high denier filaments (for low retention) and high total denier tow (for high pressure drop per unit length). Filamentary cellulose acetate tow is preferred, suitably of a filament denier of at least 5 (e.g. 7 or 8 or 9) and a total tow denier of 70 to $80\times10^3$ (e.g. about $75\times10^3$). An NWA (non-wrapped acetate) filtering plug is preferred—made, for example, as described in GB-A-1,169,932. Other fibrous and non-fibrous downstream filtering plug materials and structures can however be used (e.g. a plug of staple fibres or cellular plastics material or a plug of plastics—e.g. HDPE—fibres or filaments) provided that they have appropriate low retention and high draw resistance.

The upstream filtering plug may also be of filamentary tow, which may be of high denier filaments. Filamentary cellulose acetate tow is preferred, suitably of a filament denier of at least 5 (e.g. about 9) but with a total tow denier much less than (e.g. about half) that of the downstream plug so as to ensure the required lower pressure drop; the total denier of the upstream plug tow is for example from 35 to $40\times10^3$. A preformed WA (wrapped acetate) upstream filter plug is preferred. Other fibrous and non-fibrous upstream filter plug materials and structures can however be used (e.g. a plug of staple fibres or cellular plastics material or a plug of plastics—e.g. HDPE—fibres or filaments) provided that they give appropriate low retention and low draw resistance.

The degree of ventilation can be chosen according to the other details of the structure and the performance required of the final product, but will normally be high—e.g. from 50 to 75% or higher.

Commercially viable filters according to the invention giving satisfactory taste and draw performance in filter cigarettes can provide low CO delivery (usually less than 5 mg per cigarette compared to the value of about 6 mg per cigarette usually delivered by conventional ventilated filter cigarettes) and a low CO/Tar delivery ratio (usually less than 0.7 and preferably as low as 0.6 or less, compared to the usual value of about 1 for conventional ventilated filter cigarettes).

The filters according to the invention may be made by a continuous in-line single pass procedure. In this procedure upstream and downstream plugs are fed alternately at a constant spacing onto a continuously supplied and longitudinally advanced ribbon of filter wrapper material and the ribbon and plugs thereon are continuously passed into and through a garniture which forms the assembly into a continuous rod of spaced plugs within the cylindrical wrapper which is secured by a lapped and stuck seam. The initial continuous rod as it issues continuously from the machine outlet is cut into finite lengths for subsequent use. This cutting may be into individual filters as defined and described above, each of which is then attached to an individual wrapped tobacco rod to form a filter cigarette. More usually, however, the continuously issuing rod is first cut into double or higher multiple (usually quadruple or sextuple) lengths for subsequent use; when the initial cut is into quadruple or higher lengths, then the latter are subsequently cut into double lengths for the filter cigarette assembly—in which the double length filter rod is assembled and joined (by ring tipping or full tipping overwrap) between a pair of wrapped tobacco rods with the combination then being severed centrally to give two individual filter cigarettes. For this purpose in the present invention the filter plugs in the initial continuously produced rod are double the lengths of the plugs of the eventual individual filters. The continuous rod and the multiple lengths cut from it have individual filters according to the invention integrally joined end-to-end in mirror image relationship, and the double length rod for the mentioned filter cigarette assembly has a double length downstream plug between opposed single length cavities closed at their distal ends by respective single length upstream plugs, the cut to make the individual filter cigarettes being made laterally midway through the central double length plug. The invention includes the described production procedure and the double and higher multiple length filter rods made thereby.

BRIEF DESCRIPTION OF THE DRAWINGS

In the accompanying drawings

DETAILED DESCRIPTION

Figure 1:
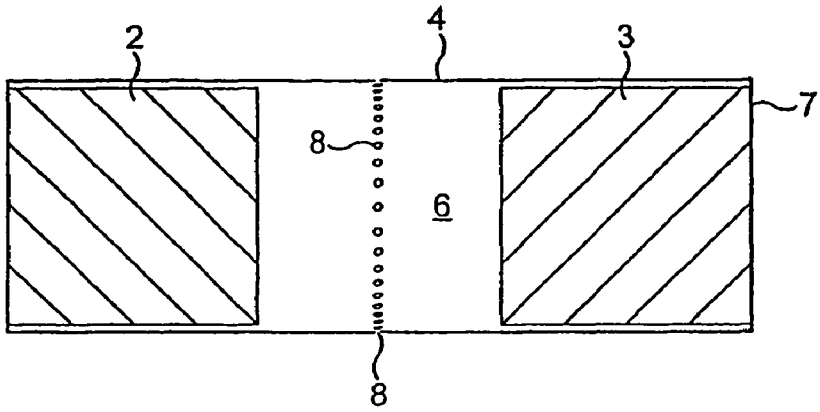
FIGS. 1 and 2 respectively are schematic sectional side elevation views, not to scale, of an individual filter and filter cigarette according to the invention.

The FIG. 1 filter has a cylindrical buccal end filtering plug 2 which is of relatively high draw resistance (pressure drop) and low tar retention, a cylindrical upstream filtering plug 3 which is of relatively low draw resistance (pressure drop) and low tar retention, and a filter wrapper 4 engaged around the plugs to form a cavity 6 therebetween.

Purely for the purpose of illustrating an optional feature (the use for the unattached filter per se of an apertured filter wrapper), the filter wrapper 4 of FIG. 1 is shown as having a ring of ventilating perforations 8 therethrough around the cavity 6. In most instances, however, the filter wrapper 4 of the unattached filter will be without any ventilating apertures; thus when the filter wrapper 4 is of inherently air-permeable material it usually need not be apertured, and when an apertured filter wrapper is desired or necessary for the filter cigarette the perforation or other hole formation may best be performed only after assembly of the preformed filter with a wrapped tobacco rod.

Figure 2:
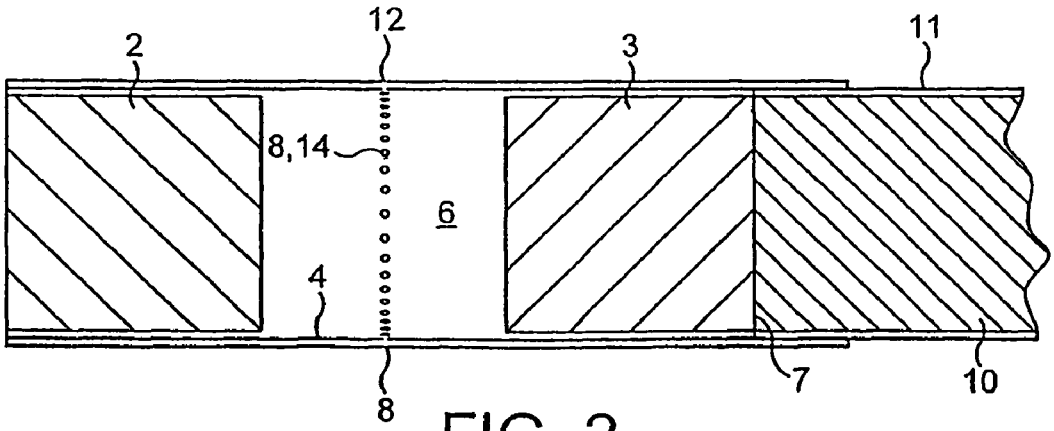

FIG. 2 shows a filter of the FIG. 1 type joined at its upstream end 7 to a tobacco rod 10 in its own wrap 11 by means of a full tipping overwrap 12 which surrounds and engages the full length of the filter and the adjacent end only of the wrapped tobacco rod 10, 11. Tipping overwrap 12 is shown as having a ring of ventilating perforations 14 around cavity 6 in register with ventilating perforations 8 through filter wrapper 4. When filter wrapper 4 is of inherently air-permeable material, perforations 8 may be unnecessary and absent, with perforations 14 being formed in overwrap 12 before assembly of the filter cigarette. When both perforations 8 and 14 are present, they are most conveniently formed simultaneously through filter wrapper 4 and tipping overwrap 12 only after assembly of the filter cigarette, so that perforations 8 and 14 coincide.

The filter of FIG. 1 might alternatively be attached to wrapped tobacco rod 10, 11 by ring tipping which extends only around the adjacent ends of the filter and tobacco rod, so that most of filter wrapper 4 is directly exposed to atmosphere. Filter wrapper 4 would then usually be of air-permeable material, and/or provided with one or more apertures around cavity 6 (before or after filter cigarette assembly), to give ventilation into cavity 6.

Figure 3:
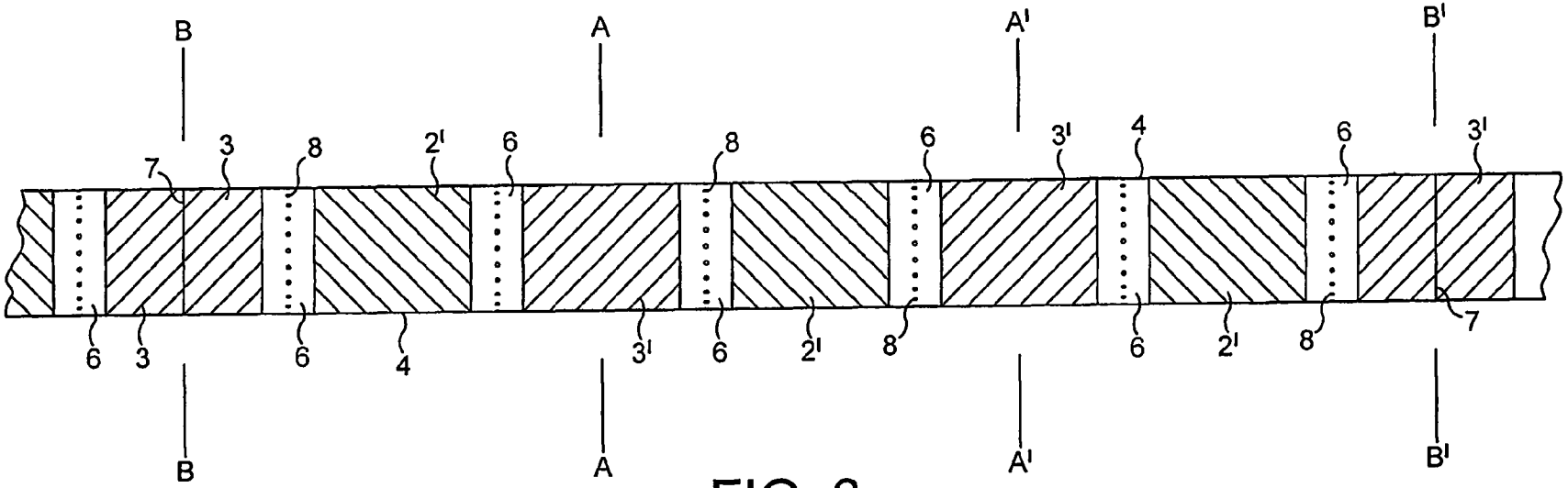
FIG. 3 is a similar view of a multiple length rod according to the invention showing how it may be cut to form multiple and eventually individual filter lengths of the invention.

FIG. 3 illustrates multiple length filter rods according to the invention. For FIG. 3 a multiple length filter rod is made continuously as described above; this filter rod continuously emerging longitudinally from a production machine outlet (not shown) to the right of FIG. 3 has plugs 2' and 3' double the length of above eventual individual filtering plugs 2 and 3, spaced apart in filter wrapper 4 by cavities 6 the same length as those of the eventual individual filters 6. Lines B mark the leading edge of the illustrated sextuple length filter rod, and lines B' the position for its trailing edge and also the location of a cutting device (not shown) downstream of said machine outlet. The advancing filter rod is about to be cut through a double length plug 3' at said location to form said trailing edge 7 and separate the sextuple length, whose leading edge 7 was formed at lines B when this rod position earlier passed said location. The part of FIG. 3 to the left of lines B indicates schematically the trailing end of the previously separated sextuple length filter rod, and that to the right of lines B' the leading end of the next to be formed. When a sextuple length filter rod as illustrated is to be used in filter cigarette manufacture it is first cut simultaneously through double length plugs 3' at lines A and A' to give three identical double length filter rods, each having a central double length plug 2' with a cavity 6 at each end closed by a single length plug 3. As previously described, each double length filter rod is then aligned between and joined to two wrapped tobacco rods and cut midway through the double length plug 2' to give two filter cigarettes of the invention. It will be evident that the continuously formed filter rod could be cut initially into other multiple (e.g. double or quadruple or octuple) lengths; and/or that single length filters as in FIG. 1, cut from multiple lengths or directly from the continuously formed filter rod, could be attached individually to single wrapped tobacco rods.

FIG. 3 shows the perforations 8 of FIG. 1, but as explained in connection with FIGS. 1 and 2, these perforations are optional and may be absent.

does not have perforations 8 as shown in FIGS. 1 and 2 and is of air-permeable paper to provide for ventilation into cavity 6. The filter rod is attached by a ventilating tipping overwrap 12 to a commercial wrapped tobacco rod 10, 11. The tipping overwrap paper has a single ring of ventilating perforations 14 around cavity 6 so that on smoking there is ingress of external air laterally through the overwrap perforations and underlying permeable filter wrapper into the cavity.

Examples 2 and 3

The filter and filter cigarette of the Examples are as described above for Example 1, except that in each the filter length is 25 mm. with 8 mm. long NWA and WA plugs and a 9 mm. cavity, the buccal end NWA plug being made from a combination of two 8/39 denier tows and having a PD of 78 mm·WG and a tar retention of 37%, and the upstream WA plug being of 8/28 tow and having a PD of 12 mm·WG and a tar retention of 16%.

The following Table compares the resulting filter cigarettes of Examples 1 to 3, which are according to the invention, with a commercial "lights" ventilated filter cigarette using the same tobacco rod with a ventilated WA filter. The filters of Examples 1 to 3 each had an overall tar retention of 45%, whereas the comparison commercial filter had a tar retention of 57%.

| | Commercial | Example 1 | Example 2 | Example 3 |
|---|---|---|---|---|
| Filter Length (mm) | 27 | 27 | 25 | 25 |
| Filter Construction | WA | NWA + Cavity + WA | NWA + Cavity + WA | NWA + Cavity + WA |
| Filter Configuration(mm) | | 10 + 7 + 10 | 8 + 9 + 8 | 8 + 9 + 8 |
| Tow Selection - NWA Segment | Not Known | Two bales (8/39 + 7/34) | Two bales (each 8/39) | Two bales (each 8/39) |
| Tow Selection - WA Segment | | 9/37 | 8/28 | 8/28 |
| Filter PD (mm WG) | 90 | 66 | 85 | 85 |
| Cigarette Open PD (mm WG) | 94 | 71 | 101 | 91 |
| Ventilation (%) | 49 | 52 | 59 | 75 |
| Tar Yield (mg/cig) | 6.2 | 8 | 8.0 | 4.3 |
| Nicotime Yield (mg/cig) | 0.53 | 0.66 | 0.64 | 0.40 |
| CO Yield (mg/cig) | 6.1 | 4.9 | 4.2 | 1.7 |
| CO/Tar Ratio | 0.98 | 0.61 | 0.52 | 0.40 |

Example 1

In a specific example of a filter and filter cigarette according to the invention as described with reference to FIGS. 1 and 2, the filter is 27 mm long and about 25 mm in circumference. The buccal end plug 2 is a 10 mm long non-wrapped acetate (NWA) plug—i.e. a preformed non-wrapped plug of plasticised cellulose acetate filaments gathered and bonded together; it is made of a mixture of two tows from two respective bales, one bale being of 8/39 denier—i.e. 8 dpf (denier per filament) and $39\times10^3$ total denier—and the other being of 7/34 denier to give a 7-8/73 denier product. A given tow specification can be processed differently to yield plugs of different performances; in this Example the processing is such that the 10 mm plug 2 has a PD of 45 mm·WG with a tar retention of under 35%. The upstream end plug 3 is a 10 mm long wrapped acetate (WA) plug—i.e. a preformed wrapped plug of plasticised cellulose acetate filaments—made from a 9/37 denier tow; it has a PD of 10.5 mm·WG with a tar retention of about 16%. The filter wrapper is 27 mm long to give a cavity 7 mm long extending between plugs 2 and 3; it Values for product and component parameters (including pressure drop, tar retention, % ventilation, permeability) disclosed herein are all as measured using industry standard (CORESTA) equipment and conditions. Thus pressure drop (draw resistance) is the pressure difference between the two ends of the filter or component concerned at a steady volumetric flow of 17.5 ml/sec, and unless indicated as "open" (measured with ventilation permitted) is measured "enclosed" (encapsulated in the measuring device, with no ventilation). Smoke component (tar, CO, nicotine etc) delivery yields are measured by smoking the cigarette on a standard (Filtrona) smoking machine under standard ISO conditions (puffs, each of 35 ml volume and 2 seconds duration, at one minute intervals), and collecting and analysing the smoke delivered. Filter and filter plug retention efficiencies are calculated by smoking the cigarette with the filter enclosed (no ventilation) and measuring the weight of tar retention by the plug(s) concerned; the tar retention is the ratio, expressed as a percentage, of this weight of tar retained in the used plug(s) to the total weight of said retained tar and delivered tar yield. The percentage ventilation (or air dilution) is the proportion of ventilating air present in the total volumetric flow from the buccal end of the cigarette; it is measured on the unlit cigarette with said total flow set at 17.5 ml/second; in practice 50% ventilation or air dilution indicates that on smoking each puff will contain an about 50/50 v/v ratio of added ventilating air to original smoke, and 40% ventilation indicates an about 40/60 ratio and so on. The CORESTA (Centre de Cooperation pour les Recherches Scientifique Relatives au Tabac) unit of air permeability is ml/min·cm$^2$ under 1 kPa.

The ISO tests used for parameter measurements herein include:

Tar Yield—ISO 4387 (Cigarettes—Determination of Total and Nicotine-free Dry Particulate Matter using a Routine Analytical Smoking Machine).

Carbon Monoxide Yield—ISO 8454 (Cigarettes—Determination of Carbon Monoxide in the Vapour Phase of Cigarette Smoke—NDIR Method).

Paper Permeability—ISO 2965 (Materials used as Cigarette Papers, Filter Plug Wrap and Filter Joining Paper, including Materials having an Oriented Permeable Zone—Determination of Air Permeability).

The invention claimed is:

1. A tobacco smoke filter having a tar retention of at most 50%, comprising a relatively high draw resistance downstream filtering plug having a tar retention from 35 to 45%, a relatively low draw resistance upstream filtering plug of at most 22% tar retention spaced longitudinally upstream from the downstream filtering plug, and a filter wrapper engaging around and joining the spaced plugs to define a cavity therebetween, the draw resistance of the downstream filtering plug being greater than the draw resistance of the upstream filtering plug.

2. A filter according to claim 1 wherein the downstream filtering plug has a draw resistance from 40 to 130 mm·WG.

3. A filter according to claim 2 wherein the draw resistance of the downstream filtering plug is from 60 to 110 mm·WG.

4. A filter according to claim 1 wherein the upstream filtering plug has a draw resistance of up to 20 mm·WG.

5. A filter according to claim 1 wherein the upstream filtering plug has a draw resistance of to 8 to 16 mm·WG.

6. A filter according to claim 1 wherein the upstream filtering plug has a tar retention from 14 to 20%.

7. A filter according to claim 1 wherein the filter wrapper is a ventilating wrapper.

8. A filter according to claim 7 wherein the filter wrapper is of air-permeable material and/or has one or more ventilating apertures in register with the cavity.

9. A filter cigarette comprising:

a filter having a tar retention of at most 50%, the filter having an upstream end and a downstream end and comprising:

a relatively high draw resistance downstream filtering plug having a tar retention from 35 to 45%;

a relatively low draw resistance upstream filtering plug having a tar retention of at most 22% and being spaced longitudinally upstream from the downstream filtering plug, the draw resistance of the downstream filtering plug being greater than the draw resistance of the upstream filtering plug;

a filter wrapper engaging around and joining the filtering plugs to define a cavity therebetween; and a pathway for allowing passage of external ventilating air laterally into the cavity; and a wrapped tobacco rod joined at one end to the upstream end of the filter.

10. A filter cigarette according to claim 9 wherein the filter and the wrapped tobacco rod are joined by a full tipping overwrap, the filter wrapper and the overwrap together defining the pathway for allowing external ventilating air to pass laterally therethrough and into the cavity.

11. A filter cigarette according to claim 10 wherein the filter wrapper is of air-permeable material and the tipping overwrap has one or more ventilating apertures in register with the cavity.

12. A filter cigarette according to claim 10 wherein the tipping overwrap has one or more ventilating apertures in register with one or more ventilating apertures in the filter wrapper and with the cavity.

13. A filter cigarette according to claim 9 having a CO delivery of less than 5 mg. and a CO/tar delivery ratio of less than 0.7.

14. A filter cigarette according to claim 9 wherein the filter and the wrapped tobacco rod are joined by ring tipping.

15. A multiple length filter rod comprising:

a plurality of filters each having a tar retention of at most 50%, each of the filters comprising:

a relatively high draw resistance downstream filtering plug having a tar retention from 35 to 45%; and a relatively low draw resistance upstream filtering plug having a tar retention of at most 22% and being spaced longitudinally upstream from the downstream filtering plug, the draw resistance of the downstream filtering plug being greater than the draw resistance of the upstream filtering plug; and a filter wrapper engaging around and joining the filtering plugs to define a cavity therebetween;

wherein the filters are joined integrally to one another end-to-end in a mirror-image relationship.

16. A filter according to claim 1 wherein the downstream filtering plug has a tar retention of about 40%.

17. A filter according to claim 1 wherein the upstream filtering plug has a tar retention of about 18%.

18. A filter according to claim 1 wherein the downstream filtering plug has a tar retention of about 40%, and the upstream filtering plug has a tar retention of about 18%.

19. A filter cigarette according to claim 9 wherein the upstream filtering plug has a tar retention from 14% to 20%.

20. A multiple length filter rod according to claim 15 wherein the upstream filtering plug has a tar retention from 14% to 20%.

* * * * *